US005823422A

United States Patent [19]

Collier et al.

[11] Patent Number: 5,823,422

[45] Date of Patent: Oct. 20, 1998

[54] BEVERAGE DISPENSER WITH POP-UP DRINKING STRAW

[76] Inventors: Douglas Allen Collier, 1621 7th Ave. W., Bradenton, Fla. 34205; Darrell Edward Brown, 3707 Gulf Dr., Holmes Beach, Fla. 34217

[21] Appl. No.: 66,699

[22] Filed: Apr. 27, 1998

[51] Int. Cl.[6] ..... B65D 5/72

[52] U.S. Cl. ..... 229/103.1; 220/707; 220/710

[58] Field of Search ..... 229/103.1; 220/705, 220/707, 708, 710; 215/388; 239/33

[56] References Cited

U.S. PATENT DOCUMENTS

| | | | |
|---|---|---|---|
| 942,306 | 12/1909 | Clarke | 215/388 |
| 2,392,479 | 1/1946 | Humbert . | |
| 3,211,379 | 10/1965 | Burton . | |
| 3,220,587 | 11/1965 | Griffin et al. | 229/103.1 |
| 3,326,695 | 6/1967 | Neuhauser . | |
| 3,542,278 | 11/1970 | Deaver | 229/103.1 |
| 3,776,458 | 12/1973 | Chunga, Sr. . | |
| 4,356,927 | 11/1982 | Cooper et al. . | |
| 4,850,533 | 7/1989 | Hoshi et al. | 239/33 |
| 4,892,187 | 1/1990 | Stein | 215/388 |
| 4,948,008 | 8/1990 | Wu et al. | 220/707 |
| 4,966,300 | 10/1990 | Coonradt | 220/707 |
| 5,148,971 | 9/1992 | Ahn . | |
| 5,282,541 | 2/1994 | Chen | 220/705 |

FOREIGN PATENT DOCUMENTS

| | | |
|---|---|---|
| 2309909 | 8/1974 | Germany . |
| 4230761 | 3/1994 | Germany . |

*Primary Examiner*—Gary E. Elkins
*Attorney, Agent, or Firm*—Stephen R. Greiner

[57] ABSTRACT

A beverage dispenser including a container having a tubular sleeve permanently secured therein. The upper end of the sleeve is provided with a peripheral collar which is secured to the top wall of the container. The lower end of the sleeve is positioned adjacent the bottom wall of the container. A drinking straw, having a compressed, accordion section, is slidably positioned within the sleeve. A releasable seal is adhesively secured atop the collar to close the opening in the upper end of the sleeve. Removal of the seal permits the compressed, accordion section to elongate and extend the upper end of the straw from the container.

8 Claims, 1 Drawing Sheet

BEVERAGE DISPENSER WITH POP-UP DRINKING STRAW

FIELD OF THE INVENTION

The present invention relates generally to fluid sprinkling, spraying and diffusing devices and, more particularly, to portable drinking tubes and straws.

BACKGROUND OF THE INVENTION

Many individuals prefer to use a straw to drink the juice, milk or other beverage packaged within a disposable container. Unfortunately, disposable beverage containers are often supplied without straws. Even when a straw is supplied, however, an individual is required to handle the straw after removing it from a protective wrapper. Of course, touching the straw with unwashed hands can result in germs being delivered to the beverage and to the mouth of the individual.

SUMMARY OF THE INVENTION

In light of the problems associated with disposable beverage containers currently available in the marketplace, it is a principal object of the invention to provide a drinking straw that can be secured within a beverage container at the time of manufacture and can automatically, and without touching the hands of a user, extend outwardly from the container when it is opened for immediate sipping of a beverage.

It is another object of the invention to provide improved elements and arrangements thereof in a beverage dispenser for the purposes described which is lightweight in construction, inexpensive in manufacture, and fully reliable in operation.

Briefly, the dispenser in accordance with this invention achieves the intended objects by featuring a drinking straw assembly secured to a container. The assembly includes a tubular sleeve secured within the container and a releasable seal for closing the upper end of the sleeve which opens through a container wall. A drinking straw is slidably positioned within the sleeve and has accordian pleats which allow the straw to be reduced in length. Preferably, the sleeve and the straw have complementally tapered lower portions which prevent the passage of the straw from the lower end of the sleeve. If desired, the assembly may be manufactured as a unit and distributed to others for subsequent attachment to a container of any desired configuration.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
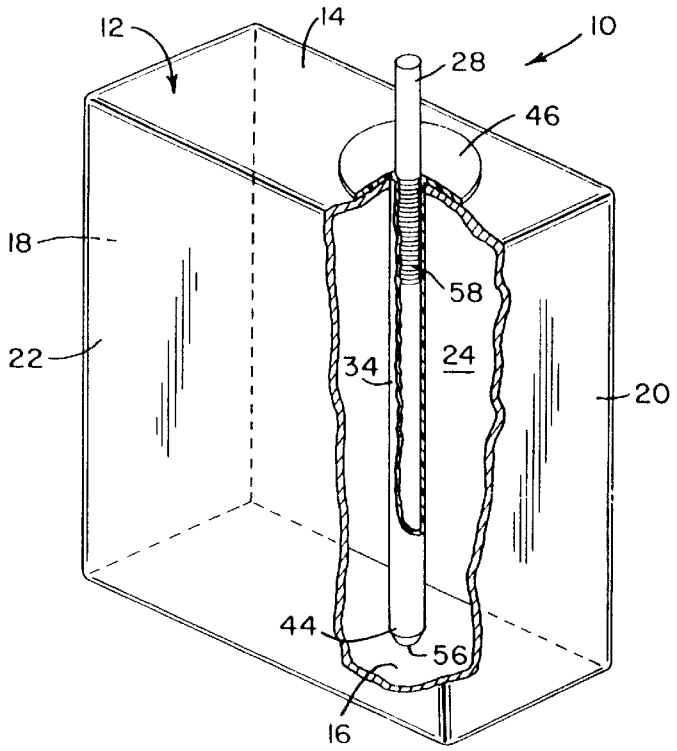
FIG. 1 is a perspective view of a beverage dispenser with pop-up drinking straw in accordance with the present invention with the releasable seal removed therefrom to extend the drinking straw.

Referring now to the FIGS., a beverage dispenser in accordance with the present invention is shown generally at 10. The beverage dispenser 10 includes a container 12 which is preferably rectangular in configuration and has top and bottom walls 14 and 16, side walls 18 and 20, and front and back walls 22 and 24. The container 12 is constructed from stiff, waterproof paper or other material suitable for holding a beverage.

A pop-up drinking straw assembly 26 is secured to the container 12. The assembly 26 includes a drinking straw 28 secured within a tubular housing 30 by means of a releasable seal 32. Preferably, the straw 28, housing 30 and seal 32 are made of plastic or other waterproof materials in order not to deteriorate while in contact with a beverage.

The housing 30 includes a tubular sleeve 34, with open, upper and lower ends 36 and 38, which is inserted into the container 12 through a close-fitting aperture 40 in the top wall 14. The sleeve 34 has an elongated, upper portion 42 of uniform diameter along its length. Integrally fastened to the bottom of the upper portion 42 is a conical, lower portion 44 which tapers radially inward to terminate at the lower end 38 of the sleeve 34.

An integral, peripheral collar 46 extends outwardly from the upper end 36 of the sleeve 34 and has an outer diameter larger than that of the aperture 40. The collar 46 is adhesively secured to the top wall 14 so that the sleeve 34 is permanently suspended within the container 12 with its lower end 38 positioned a slight distance above the bottom wall 16.

The seal 32 includes a flexible sheet 48 which is releasably secured by a ring of adhesive 50 to the top of the collar 46. Preferably, the sheet 48 has a diameter substantially identical to that of the collar 46 and is centered thereon. For easy removal of the sheet 48 from the collar 46, the sheet is provided with an integral, pull tab 52.

The straw 28 is slidably positioned within the sleeve 34 and, prior to use, beneath the seal 32. The straw 28 includes an elongated, upper portion 54 having a diameter that is both slightly less than that of the upper portion 42 of the sleeve 34 and slightly more than that of the lower end 38 of the sleeve. Integrally fastened to the bottom of the upper portion 54 is a conical, lower portion 56 adapted to annularly abut the lower portion 44 of the sleeve 34. Because the straw 28 may be trapped within the sleeve 34 between the seal 32 and lower portion 44, the assembly 26 may be manufactured as a separate unit for subsequent attachment to the container 12.

Figure 2:
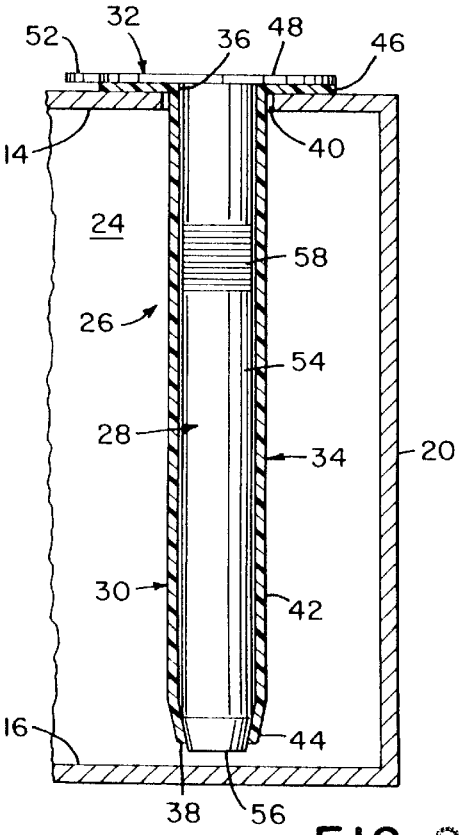
FIG. 2 is an enlarged, cross-sectional view of a portion of the beverage dispenser of FIG. 1 with the pleats of the drinking straw in a compressed state.
Figure 3:
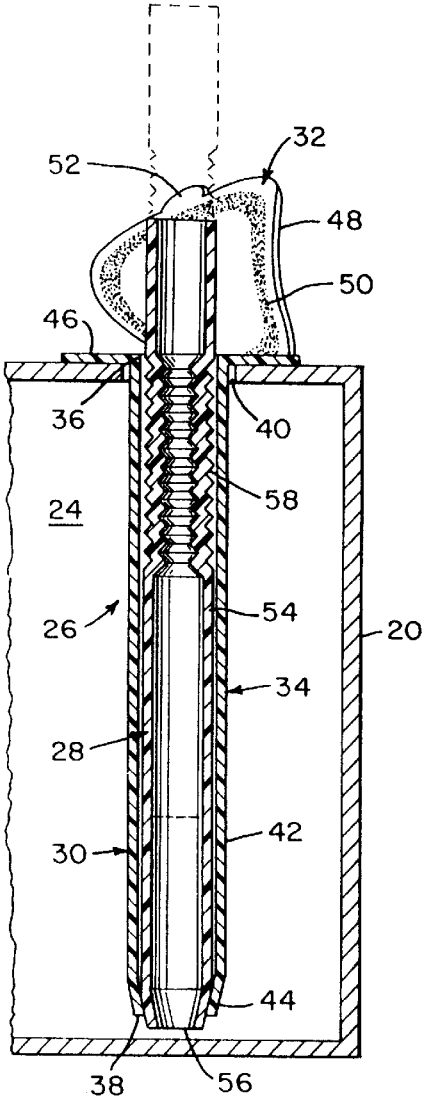
FIG. 3 is an enlarged, cross-sectional view of a portion of the beverage dispenser with the pleats of the drinking straw in an uncompressed state.

To permit the straw 28 to be fitted entirely within the sleeve 34, a plurality of circular, accordion pleats 58 are formed in the upper portion 54 of the straw. Preferably, the pleats 58 are longitudinally compressed during manufacture to reduce the length of the straw 28 and permit its snug positioning within the sleeve 34. While a beverage is being stored and transported within the container 12, the straw 28 is retained in a compressed state between the seal 32 and the lower end 38 of the sleeve 34 as shown in FIG. 2. When the seal 32 is removed from the container 12 for dispensing, however, as shown in FIGS. 1 and 3, the upper portion 54 of the straw 28 will "pop-up" or extend from the upper end 36 of the sleeve 34 so that a user can sip a beverage therefrom.

During use of the dispenser 10, the lower portion 56 of the straw 28 normally remains in abutment with the lower portion 44 of the sleeve 34. Such positioning sets the bottom of the straw 28 in close proximity to the bottom wall 16 of the container 12 so that essentially all of the beverage in the container may be sipped through the straw. Nevertheless, if the container 12 is relatively full of beverage and a user so desires, the straw 28 may be slid upwardly in the sleeve 34 to the broken-line position of FIG. 3 so that the lower portions 44 and 56 are spaced apart and more of the upper portion 54 of the straw projects from the upper end 36 of the sleeve 34.

The container 12 may tend to collapse slightly as its liquid contents are withdrawn. To admit air to the interior of the container 12 as a beverage is sipped through the straw 28, an optional air vent (not shown) may be provided in the upper portion 54 of the sleeve 34. Without the vent, air will fill the container 12 through the straw 28 after each sip when the lips of a user are removed therefrom.

While the invention has been described with a high degree of particularity, it will be appreciated by those skilled in the art that modifications may be made thereto. For example, the sleeve 34 need not be secured to the collar 46 at right angles as shown in the FIGS., but may be secured thereto at any desired angle to permit the drinking straw assembly 26 to be suitably attached to containers of non-rectangular shape. Therefore, it is to be understood that the present invention is not limited to the sole embodiment described above, but encompasses any and all embodiments within the scope of the following claims.

We claim:

1. A beverage dispenser, comprising:

a container;

a tubular sleeve secured within said container and having an end extending through the top of said container;

a releasable seal for closing and sealing said end of said tubular sleeve; and, a drinking straw having a diameter smaller than that of said tubular sleeve and being slidably positioned within said tubular sleeve, and said drinking straw also having a plurality of accordian pleats for compressing said straw in said tubular sleeve.

2. The beverage dispenser according to claim 1 wherein said tubular sleeve and said drinking straw have complementally tapered lower ends so as to provide an interlocking engagement between said tubular sleeve and said drinking straw which prevents the passage of said drinking straw from said lower end of said tubular sleeve when said lower end of said drinking straw is pressed downward.

3. A drinking straw assembly for use with a beverage container, said drinking straw assembly comprising:

a housing adapted for attachment to a beverage container, said housing including:

a tubular sleeve having open, upper and lower ends for positioning within a beverage container, said tubular sleeve also having a first, integral, lower portion tapering downwardly and inwardly to terminate at said lower end thereof; and, a peripheral collar extending outwardly from said upper end of said tubular sleeve for attachment to the exterior of a beverage container;

a releasable seal secured to said peripheral collar for closing and sealing said upper end of said tubular sleeve; and, a drinking straw slidably positioned within said tubular sleeve, said drinking straw having a diameter that is slightly larger than that of said lower end of said tubular sleeve, said drinking straw also having a plurality of accordian pleats for compressing said drinking straw between said first, lower portion and said releasable seal.

4. The beverage dispenser according to claim 3 wherein said drinking straw includes open, upper and lower ends and has a second, integral, lower portion tapering downwardly and inwardly to terminate at said lower end thereof, said second, lower portion being adapted to abut said first, lower portion of said tubular sleeve when said drinking straw is compressed within said tubular sleeve.

5. The beverage dispenser according to claim 3 wherein said tubular sleeve and said collar are integrally formed from plastic.

6. A beverage dispenser, comprising:

a container;

a drinking straw assembly secured to said container, said assembly including:

a housing adapted for attachment to a beverage container, said housing including:

a tubular sleeve positioned within said container, said tubular sleeve having open, upper and lower ends and, also, having a first, integral, lower portion tapering downwardly and inwardly to terminate at said lower end thereof; and, a peripheral collar extending outwardly from said upper end of said tubular sleeve attached to the exterior of said container;

a releasable seal secured to said peripheral collar for closing and sealing said upper end of said tubular sleeve; and, a drinking straw slidably positioned within said tubular sleeve, said drinking straw having a diameter that is slightly larger than that of said lower end of said tubular sleeve, said drinking straw also having a plurality of accordian pleats for compressing said drinking straw between said first, lower portion and said releasable seal.

7. The beverage dispenser according to claim 6 wherein said drinking straw includes open, upper and lower ends and has a second, integral, lower portion tapering downwardly and inwardly to terminate at said lower end thereof, said second, lower portion being adapted to abut said first, lower portion of said tubular sleeve when said drinking straw is compressed within said sleeve.

8. The beverage dispenser according to claim 6 wherein said tubular sleeve and said collar are integrally molded from plastic.

* * * * *